US005882258A

United States Patent [19]

Kelly et al.

[11] Patent Number: 5,882,258

[45] Date of Patent: Mar. 16, 1999

[54] SKILL-BASED CARD GAME

[75] Inventors: Matthew F. Kelly, San Ramon, Calif.; Bryan M. Kelly, Scottsdale, Ariz.

[73] Assignee: RLT Acquisition, Inc., Pleasanton, Calif.

[21] Appl. No.: 924,975

[22] Filed: Sep. 8, 1997

[51] Int. Cl.[6] ..... A63F 1/00

[52] U.S. Cl. ..... 463/11; 463/16; 463/23; 273/292

[58] Field of Search ..... 463/23, 16, 11; 273/292, 293

[56] References Cited

U.S. PATENT DOCUMENTS

| | | | |
|---|---|---|---|
| 3,796,433 | 3/1974 | Fraley et al. | 463/12 |
| 4,743,024 | 5/1988 | Helm et al. | 273/143 R |
| 4,948,133 | 8/1990 | Helm et al. | 273/124 A |
| 5,184,821 | 2/1993 | Korenek | 273/138.2 |
| 5,711,715 | 1/1998 | Ringo et al. | 273/293 |

OTHER PUBLICATIONS

"Block Solitaire Elevens", Scarne's Encyclopedia of Games, John Scarne, Harper & Row Publishers, pp. 386–387, 1973.

Solitaire Game in Microsoft Windows for Workgroups, version 3.1 Microsoft copyright 1985–1993, developed by Wes Cherry, 4 pages, 1985.

*Primary Examiner*—Benjamin H. Layno
*Attorney, Agent, or Firm*—Hickman & Martine, LLP

[57] ABSTRACT

A method and apparatus for providing a skill-based card game. A game apparatus displays cards on a display screen. The cards are provided from a deck to played by a player according to rules of the card game, where the player can make moves during the game with the drawn cards. A game score is based on the moves made by the player during the card game. The time duration in which the player makes the moves is recorded, and does not include time expired during the game in which moves cannot be made by the player. The game score is modified based on the time duration such that the less time expired during the moves, the greater the game score. The player can be penalized when the player fails to make a move when a move is possible. Also, equalized decks reduce the randomness of available moves during the card game. In one embodiment, the card game is similar to Solitaire, drawn cards are moved onto other cards in a display area as appropriate. In another embodiment, a drawn card and one or more other displayed cards are selected to sum to a predetermined value.

33 Claims, 5 Drawing Sheets

SKILL-BASED CARD GAME

BACKGROUND OF THE INVENTION

1. Field of the Invention

This invention relates to card games, and more particularly to card games implemented on or with an electronic or computer apparatus.

2. Background of the Related Art

Games of many types are played in both private and public places. One popular type of game are card games, in which players manipulate cards from a deck to achieve a desired game outcome. For example, games based on the traditional 52-card deck, such as blackjack, solitaire, and poker, are well-known and liked by many people. Typically, a combination of both skill of the player and luck helps determine who wins the card game. For example, the skill of the player in such situations as when to discard cards, when to draw new cards, recognizing a potentially winning combination, or predicting future card draws and other player's actions can influence the result of the game. However, luck plays a more central role in most card games since the cards have been shuffled together or otherwise randomized, and which (random) cards are drawn during a game substantially affects which player wins the game.

Cards games are also quite popular in gambling environments, such as a casino. Games such as blackjack are popular in the traditional method of a dealer passing physical cards to players, where players bet money on the game outcome. In addition, card games are commonly implemented with the use of a computer apparatus and video screen to portray card images on the screen which the player must manipulate as in the traditional game. The player inserts money into the game, and the cards are randomly provided to the player from a deck similar to the traditional game so that the player will sometimes be rewarded with a money payback when a particular outcome is achieved. Thus, video poker, video blackjack, and other games are widespread in casinos. The randomness of which cards will be drawn in both the traditional form and in the video implementations is quite attractive to the casinos, since the odds of the player winning can be determined and allow the casino to determine how much money players will input to a game and how much money, on average, the casino will keep. Since skill plays a minor role in these games, the casino is relatively assured of an average income from a game.

Besides traditional gambling games, games which offer prizes to players have become popular in recent years. For example, in a traditional ticket redemption arcade, players receive tickets or prizes for playing a game, where the number of received tickets or the worth of the prize is based on a score or other outcome of the game. The player may later exchange won tickets for prizes.

One problem with the random factor of card games occurs when card games are desired to be played in non-gambling environments, such as many of the redemption arcades mentioned above. Many areas have rules or laws which prohibit gambling-type games, in which a player inserts money into the game and may win money or a prize based on the game's random outcome. Card games such as video blackjack and video poker are typically considered random enough to be gambling games, and are often prohibited in areas where gambling is banned. Thus, most prize or ticket games allowed in a non-gambling environment are games whose outcomes are based to a greater degree on the skill of the player and less on random results in the game.

This is a problem for an operator who wishes to provide a well-known card game to players in a non-gambling environment, where prizes or tickets can be won by the player of the card game. For example, a video solitaire card game can be provided in which a player must insert money to play and may win a prize if the player wins the game. However, since traditional solitaire provides cards randomly from a simulated deck, it will not be allowed in many non-gambling areas. This prevents players from playing well-known and entertaining card games in non-gambling environments. What is needed are implementations of well-known card games that allow a player to exert more skill in influencing the card games' outcome so that the card games can be played in non-gambling environments, and are more entertaining and rewarding for the player.

SUMMARY OF INVENTION

The present invention provides a card game that allows a player to exercise skill to all enhanced degree when achieving game goals. The randomness factor of the game, which traditionally has exerted a great influence on achieving the goals of many card games, is reduced by providing a time-based card game that rewards faster play by the player but only allows time to affect game score when player skill can influence the game. In addition, equalized decks reduce the luck factor of card randomness on the game.

More specifically, the method of the present invention provides a card game, preferably on a game apparatus, for a player to play. The game apparatus, for example, can take the form of a bar-top-style or arcade game console including a game processor, display screen and player controls. Cards, which can be images displayed by the display screen, are provided from a deck to played by a player according to rules of the card game, where the player can make moves during the game with the drawn cards. A game score based on the move made by the player during the card game is provided. In addition, the time duration in which the player makes the moves is recorded. This time duration does not include time expired during the game in which moves cannot be made by the player in the card game. The game score is adjusted or modified based on the time duration such that the less time expired during the moves, the greater the game score, i.e., the game score is inversely proportional to the time duration.

In the preferred embodiment, the player plays the game in exchange for monetary input that is provided to the game apparatus. In the preferred embodiment, the game score is adjusted by dividing the game score by the time duration recorded. Thus, a higher game score is achieved by a lower time that expires when moves are available.

The time duration can be displayed to the player on the display screen and is preferably updated only after the player makes a move in the game. In addition, the player can be penalized when the player fails to make a move when a move is possible and instead, for example, draws a new card.

In one embodiment, the card game is similar to the card game Solitaire, where the moves that the player may make during the card game include moving a drawn card from the deck onto another card in a card display area when predetermined conditions apply, e.g., when the moved card has 1 less value and a different color suit than the card onto which it is moved. In another embodiment, the card game can include moves in which the player selects a card provided from the deck and one or more other cards provided in a card display area such that the selected cards have values that sum to a predetermined value.

In preferred embodiments, the deck from which the cards are drawn is an equalized deck having a predetermined minimum number of moves that are guaranteed to be available to a player. The equalized deck can be randomly selected by the game apparatus from multiple available equalized decks. The equalized decks reduce the randomness of available moves during the card game and allow different games to be more equal with regard to the randomness, allowing a player's skill to have greater influence on the game. In some embodiments, a specific prize goal can be provided during the card game that may be achieved by skill of the player. If the specific prize goal is achieved, the player receives a specific prize. For example, the specific prize is provided to said player by dispensing a specific prize ticket which describes said selected prize and which said player may redeem to receive said selected prize. The game apparatus of the present invention provides a card game similar to the method described above.

The card game of the present invention advantageously allows a player to exercise skill to an enhanced degree in the game. By recording the time that a player takes to make moves, not recording time during the game in which no moves are possible, and using the recorded time to modify game score, the game allows the skill of the player in recognizing moves and making moves to have a direct bearing on the game score. This, in turn, has a direct bearing on any prizes or other payout received by the player based on game results. The game results can also be penalized when the player fails to make a move when a move is possible. In addition, the equalized decks of the present invention reduce the randomness of card game in which cards are drawn from a deck. These features can allow card games that were traditionally prohibited from non-gambling environments to be used in many such environments, since the card games of the present invention emphasize the skill of the player and not the luck of the draw.

These and other advantages of the present invention will become apparent to those skilled in the art after reading the following descriptions and studying the various figures of the drawings.

DETAILED DESCRIPTION OF THE PREFERRED EMBODIMENTS

Figure 1:
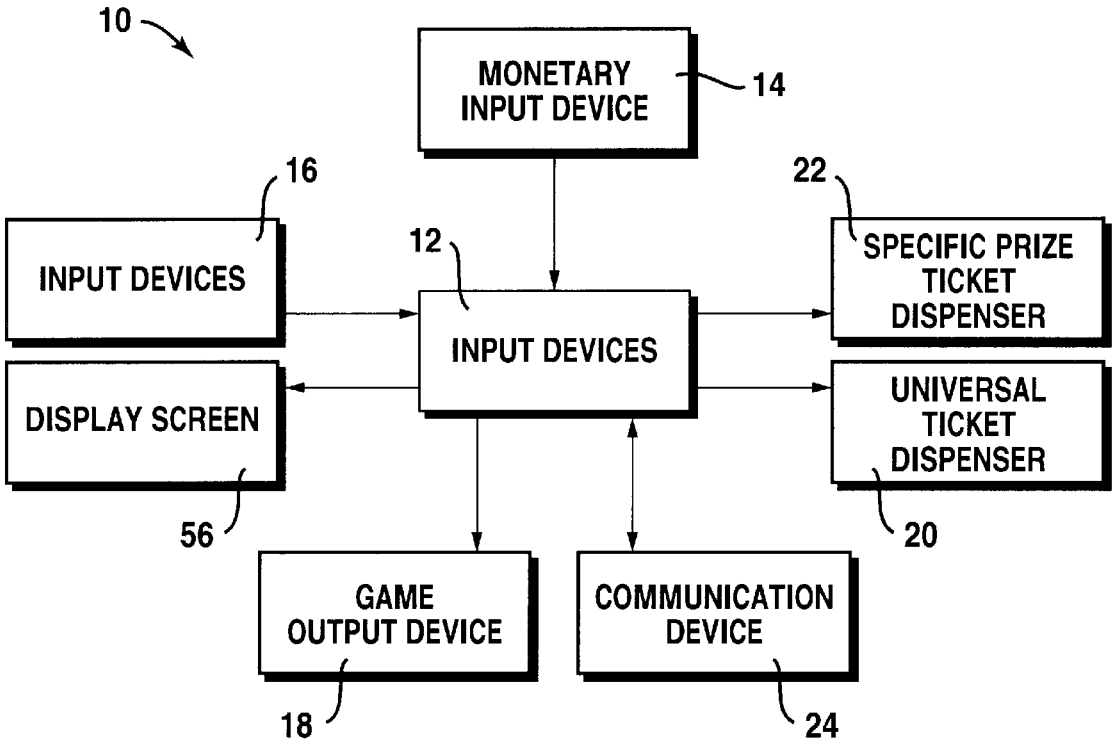
FIG. 1 is a diagrammatic illustration of a game apparatus suitable for use with the present invention.

FIG. 1 is a block diagram of a generic game apparatus or "game unit" 10 suitable for use with the present invention. It should be noted that a variety of game architectures can be used to provide game play functions. The particular architecture shown is a generic architecture using components typical to game apparatuses suitable for use with the present invention. Game unit 10 can take a variety of forms, including a video arcade game apparatus having one or more display screens, a personal computer system (desktop or portable), a "network computer", a television including or connected to a microprocessor (e.g. a "set top box") for Internet or other information access, or other apparatus.

Game unit 10 in accordance with the present invention may include a game processor 12, monetary input device 14, player input device(s) 16, game output device(s) 18, a universal ticket dispenser 20, a specific prize ticket dispenser 22, and a communication device 24.

Game processor 12 controls and monitors the functions of the game unit 10 during a game process and includes several input and output functions. The game processor controls the game apparatus by receiving inputs from a player, from a progressive bonus apparatus, and/or from other sources. The game processor also controls output signals to update the game process when appropriate. In addition, the game processor may control a redemption system included on game unit 10 by calculating when prizes are awarded, calculating and updating prize lists and prize costs, and other functions. Such a redemption system is described in greater detail in co-pending patent application Ser. No. 08/746,755, hereby incorporated by reference herein. Game processor 12 preferably includes a digital microprocessor or similar controller device, and other electronic components which are described in further detail with respect to FIG. 1*a*. The game processor is preferably provided within a housing of game unit 10.

Monetary input device 14 is used to receive monetary input that is inserted by a player into the game apparatus. For example, coins can be received in return for the player's use of the game apparatus. A coin deposit slot can accept standard currency coins, bills, or game tokens that may be available in the gaming environment, and also typically includes a coin return button and coin return slot. Once one or more coins are accepted, the coins are routed to a cash box and a signal is sent to game processor 12 to increase the player's game credits, i.e., to indicate to that one or more game plays have been paid for. Coin slots and boxes suitable for use in game unit 10 are readily available on the commercial market. Alternatively, other monetary input devices can be used, such as debit card or credit card readers well known to those skilled in the art, or "smart card" readers which can read and write electronic information to and from the card. For example, "E-cash", "cybercash" or other electronic monetary forms can be used. In other embodiments, user verification or validation can be input by the player, such as a player identification and/or password that, for example, allows a monetary value to be billed to a player or deducted from a player's monetary account at a bank or other institution. Herein, the term "monetary input" is intended to also refer to other types of player validation for use of a game in addition to those forms mentioned above. In alternate embodiments located in non-public gaming environments (e.g., at a user's home), or for other applications such as promotional uses of game apparatus 10, monetary input may not be necessary for the player to use game apparatus 10.

Input devices 16 are used by a player or user to provide input to the game unit 10 to influence game events during a game process and to achieve one or more predetermined goals or tasks for scoring points and winning prizes or other types of awards. The input devices 16 can also be used to select prizes within a redemption system if such is included. Player input typically includes game commands provided by controlling devices 16 such as buttons, mouse, dials, joystick controls, touch screen, track ball, speech input through a microphone, etc. For example, the player can move a track ball to move a pointer to a card image on the screen, and press a button to select the card. The user input can provide a particular game command to the game processor 12, and the game processor interprets the commands and influences game states and game events in the game process accordingly.

Preferably, game unit 10 implements, a card game that is a "game of skill", in which a predetermined goal, task, or objective for a game is accomplished in a skillful manner such that an outcome of the game is determined primarily by the amount of skill of the player. The greater the player's skill, the closer or more easily a desired goal in the game can be reached by the player. Points associated with the predetermined goals or objectives can be added to a game score such that a higher game score, on average, indicates a greater amount of skill by the player. For instance, patterns or other game moves can be recognized by a player using skill, or a displayed object can be skillfully aimed or directed using input devices 16 using dexterous skill involving hand-eye coordination.

Game output devices 18 may influence the game and/or provide feedback to the player about the current state of the game process. A preferred output device is a display screen 56. Game processor 12 utilizes appropriate display drivers, graphics chips, and/or other well-known components to display and update images on the display screen for implementing a game and providing information for a redemption system, if present. Game output devices such as speakers, buzzers, alarms, and other devices provide auditory feedback such as sound effects during a game process, synthesized or recorded speech, etc. One or more of the game output devices can also be used to display information related to specific prizes that can be won by the player when using the game unit 10. Game processor 12 preferably commands such feedback to the player by sending out control signals to the various output devices in game unit 10 when appropriate.

In a typical game process of game unit 10, a series of game states occur until a game conclusion is reached. The player can influence game states with game commands, but game states will often also change without any user input, such as when a time limit expires. The game conclusion can be triggered by a particular game state or other condition. At the game conclusion, the player's performance and/or skill in the game is preferably related back to the player using one or more output devices 20 in a form such as game score and/or prize credits.

Universal ticket dispenser 20 can be included in some embodiments of game unit 10 used to dispense universal tickets or other universal vouchers to a player. The universal vouchers are used to redeem prizes available in the gaming environment. For example, tickets can be dispensed from ticket dispensing mechanisms well-known to those skilled in the art. "Universal tickets" are generic and not specific to any prize, and can be accumulated by a player and used to redeem one or more of several prizes available to the player, as in a standard redemption game arcade. Typically, an operator of the arcade provides a separate prize display booth or prize vending machine which accepts the universal tickets as currency in exchange for one or more prizes. The term "prize", as used herein, is intended to generically refer to any merchandise, souvenir, food item, a promotional coupon, or other physical goods or services which can be offered to players of redemption games and which have value other than as a medium of exchange for use in the gaming environment. Other types of objects or items can also be dispensed and used as universal vouchers, such as plastic or cardboard chips, tokens, etc., or even coins or other currency.

The amount of universal tickets dispensed to the player is typically based upon a game score or other result of a game process. In addition, special or progressive goals may be achieved by the player to win an additional or specified number of universal tickets. The game processor 12 can issue commands to start the dispensing of tickets, dispense a particular number of tickets, and stop dispensing tickets. The tickets are stored in a storage area, such as a receptacle behind a front panel of the game unit 10, as is well known to those skilled in the art. Alternatively, the tickets can be awarded as a number printed on a single ticket, such as a specific prize ticket detailed below.

Specific prize ticket dispenser 22 is optionally included in game unit 10 to dispense special tickets, coupons, or other vouchers for specific prizes to the player of the game unit. Specific prize tickets are to be distinguished from the universal tickets described above. A "specific prize" or "instant prize", as referred to herein, is a particular prize or type of prize that a player can be directly and immediately awarded and, in most cases, can immediately receive due to a particular winning result on game unit 10. For example, a slice of pizza, a pitcher of cola, a bicycle, a stuffed bear, a coupon or ticket to a local movie theater, or a video game console are specific prizes. Preferably, the player redeems the specific prize by paying an appropriate specific prize ticket to an operator, vending machine, etc., that the player received from ticket dispenser 22 based on a particular winning result on the game unit. A "specific prize ticket", "specific prize coupon" or "specific prize voucher", as referred to herein, is a ticket, coupon, or other physical or electronic voucher that can be exchanged for the specific prize only, and cannot be exchanged for other types of prizes or accumulated to purchase several types of prizes. A specific prize ticket refers to an associated specific prize in some way and has a standardized format that is recognizable and verifiable by the prize supplier or operator. For example, a specific prize ticket can include on its face a text description and/or a pictorial description of the particular prize won. The specific prize ticket can also be provided in electronic form. Specific prize tickets are described in greater detail in copending patent parent application Ser. No. 08/628,490. Specific prize ticket dispenser 22 can be a printing device, such as a laser printer, ink printer, or thermal printer, that outputs a slip of paper including a text description and/or pictorial representation of the specific prize which can be redeemed for the ticket. The specific prize ticket dispenser 22 is controlled by game processor 12 similarly to dispenser 20 described above. The specific prize ticket dispenser 22 can also be used to dispense universal tickets by printing the number of tickets won on the dispensed ticket.

Alternatively, specific prizes can be claimed and received in some other manner than by ticket redemption. For example, a message can be displayed on a display screen indicating that the specific prize has been won and viewed by an operator or prize supplier, or the operator can have access to a central computer or game that is linked to game unit 10 through communication device 24 and remotely verify that the a specific prize has been won and reset the game apparatus from the central computer.

Communication device or link 24 can optionally be included to allow game unit 10 to communicate with other game apparatuses or with other computing, storage, and/or processing devices, such as a progressive bonus apparatus or server. For example, a separate progressive bonus apparatus can be provided which is connected to multiple game units 10 through communication devices 24. Each individual game unit 10 contributes to a collective progressive score that is stored and displayed by the bonus apparatus. The progressive score, for example, can be incremented with every coin inserted in input device 14 of any linked game unit, or automatically incremented over time at regular or random intervals, manually incremented by an operator of the progressive apparatus, etc. The progressive score is accumulated from the current and previous games that have been played on the linked game units 10. The first player that achieves a predetermined progressive goal on any of the linked game apparatuses wins the progressive bonus score and thus allows that player to win a greater number of universal tickets and/or specific prize tickets associated with the progressive score. Alternatively, an individual progressive score can be accumulated on a single, individual game apparatus 10 and displayed on a progressive score display separate from a game score display. Progressive goals, scores, and bonus apparatuses are described in greater detail in U.S. Pat. 5,292,127, by Kelly et al., and co-pending patent application Ser. No. 08/374,490, by Kelly et al, both of which are hereby incorporated by reference herein in their entirety.

Communication device 24 can also be used to communicate directly or indirectly with other game units 10 and other processing devices to allow multiple players to participate in a game process. Communication device 24 can also be used to allow game unit 10 to communicate with an operator, server, or other central controller that regulates and coordinates prize distribution to game apparatuses linked to the controller in a redemption system. For example, prize information, card decks (such as the equalized decks of the present invention), game preferences, game options, game variables, or other game pertinent information can be transmitted between servers and game units, between two game units, and/or between servers. Communication device 24 can be implemented as any one of many devices well known to those skilled in the art, such as a network interface card coupled to a main bus of the system, a telephone modem, a cable modem, a direct network connection, other device for communicating information according to standard network or modem protocols, a wireless transmitter/receiver for communicating without the use of cables or wires, etc.

Figure 1A:
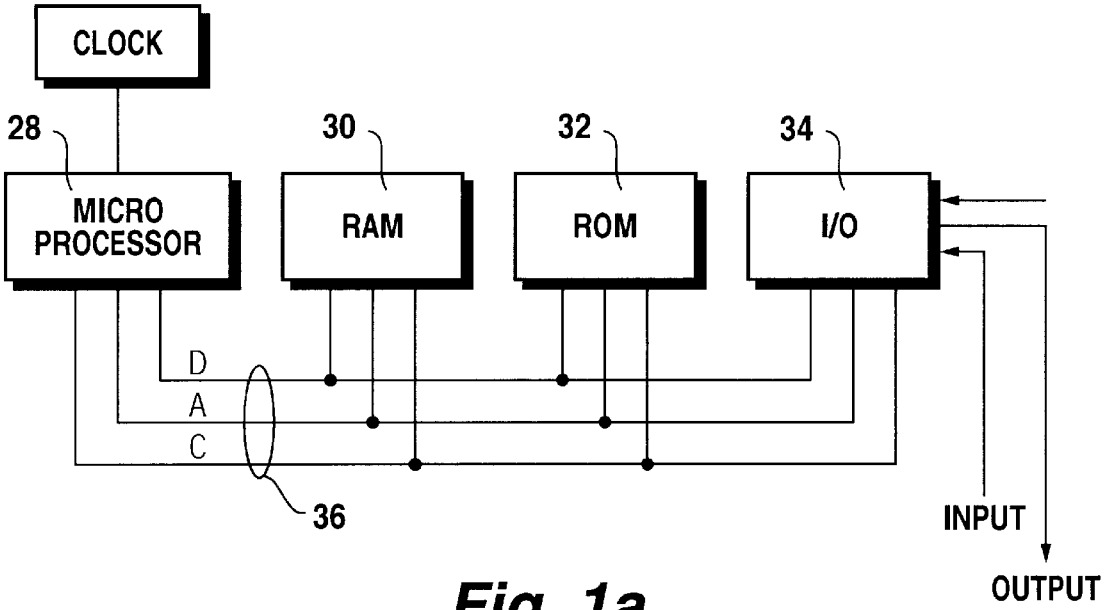
FIG. 1*a* is a block diagram of a game processor used in the game apparatus of FIG. 1.

FIG. 1*a* is a block diagram of a preferred game processor 12 of FIG. 1. Game processor 12 receives signals and commands from the player input devices 16 and translates/interprets those signals and commands so that the game process can be updated. Game processor 12 preferably includes a microprocessor 28, random access memory (RAM) 30, read-only memory (ROM) 32, and input/output (I/O) 34. Microprocessor 28 can be any processor or controller with features sufficient to control the game apparatus. For example, a Pentium-class/Power PC class microprocessor, or specialized graphical or digital signal processors, can be used. Microprocessor 28 executes a process, described by software instructions stored in memory, which recognizes a game command from player input devices 16. The software instructions can be stored in a "computer readable medium", which, by way of example, includes memory such as RAM and ROM, magnetic disks, magnetic tape, optically readable media such as CD ROMs, semiconductor memory such as memory chips or PCMCIA cards, etc. In each case, the medium may take the form of a portable item such as a small disk, diskette, cassette, memory module, etc., or it may take the form of a relatively larger or immobile item such as a hard disk drive.

Microprocessor 28 is coupled to RAM 30 by a data (D)/address (A)/control (C) bus 36 to permit the use of RAM for scratch-pad memory and other functions during a game process. ROM 32 is preferably an erasable, programmable read-only memory (EPROM) that contains the start-up instructions and operating system for the microprocessor 28. Much of the instructions to implement the process of FIG. 4 can be stored in ROM 32 or on another computer readable medium. Methods for coupling RAM 30 and ROM 32 to the microprocessor 28 by bus 36 including data, address, and control lines are well-known to those skilled in the art.

I/O 34 includes buffers, drivers, ports, registers, and other analog and/or digital circuitry to interface inputs and outputs with the bus 36. Game output devices 18 and input devices 16 can be coupled to I/O 34. For example, a display screen can be coupled to I/O 34 so that the microprocessor or another video processor can control the display of images on the display screen, as is well known to those skilled in the art.

Figure 2:
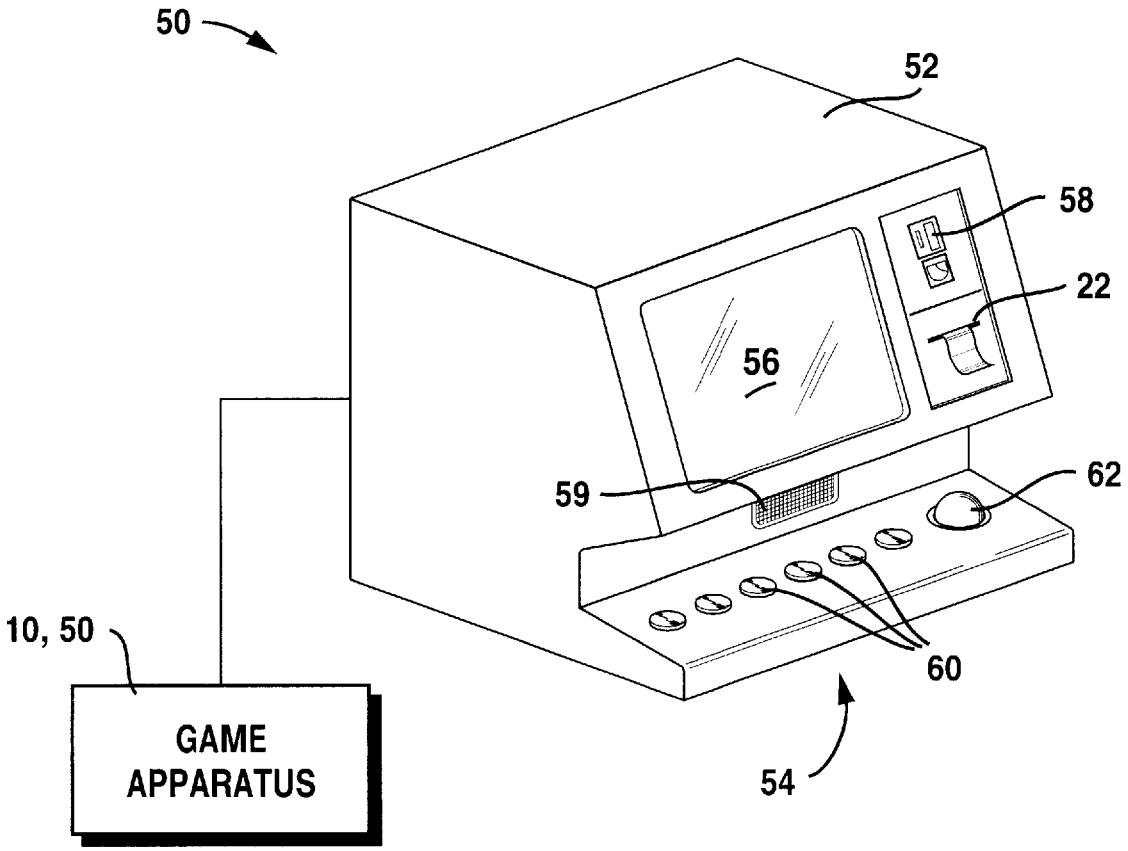
FIG. 2 is a perspective view of an embodiment of the game apparatus of FIG. 1.

FIG. 2 is a perspective view of one embodiment 50 of game unit 10 which can implement the card games of the present invention. Game unit 50 is a multi-function game station or game console which is intended to implement multiple types of games using one apparatus, as described below. Game station 50 includes a housing 52, player controls 54, display screen 56, coin slot 58, speaker 59, and specific prize ticket dispenser 22 (a universal ticket dispenser 20 can also be included in other embodiments).

Housing 52 encloses and supports the components of the game unit 50. Player controls 54 allow a player to provide player input as described with reference to FIG. 1. The player controls preferably include a number of buttons 60 and a track ball 62. Buttons 60 can be used by a player to input selections or actions offered during games. For example,.during a solitaire game showing columns of cards, a button 60 can be used to select cards, while track ball 62 allows a player to control a cursor. Alternatively, many other types of player controls can be used. For example, display screen 56 can be provided as a touch screen for reading the positions of objects (such as fingers, styluses, etc.) that contact the screen. This allows players to select objects displayed on the touch screen by pressing a finger or other object directly on the screen at the positions of the displayed objects, as is well known to those skilled in the art. Alternately, other input and output devices can also be included in game unit 50 as described with reference to game unit 10, such as a computer keyboard, mouse, stylus and tablet, etc.

Images can be displayed and updated on display screen 56 by game processor 12 or other controllers by methods well known to those skilled in the art. Coin slot 58 is provided for the player to insert one or more coins before starting a game and can be implemented as described above. Other monetary input devices, such as card readers, can be provided in other embodiments. Specific prize ticket dispenser 22 is implemented as described above.

Multi-use game unit 50 can be used in a variety of gaming environments. For example, game unit 50 is small enough to be easily located, thus allowing the game unit to be provided as a "bar top" game in a bar, restaurant, gaming arcade, or similar environments and locales. The redemption system of the present invention can thus be used in these non-gambling environments.

The bar top game 50 can offer one of several different types of video card games utilizing images displayed on display screen 56. Some examples of games are described in greater detail below. Multi-use game unit 50 is also ideally suited for linked or networked game play utilizing a communication device 24. A single game unit 50 can be linked with one or more other game units 50 to allow multiplayer games.

Figure 3:
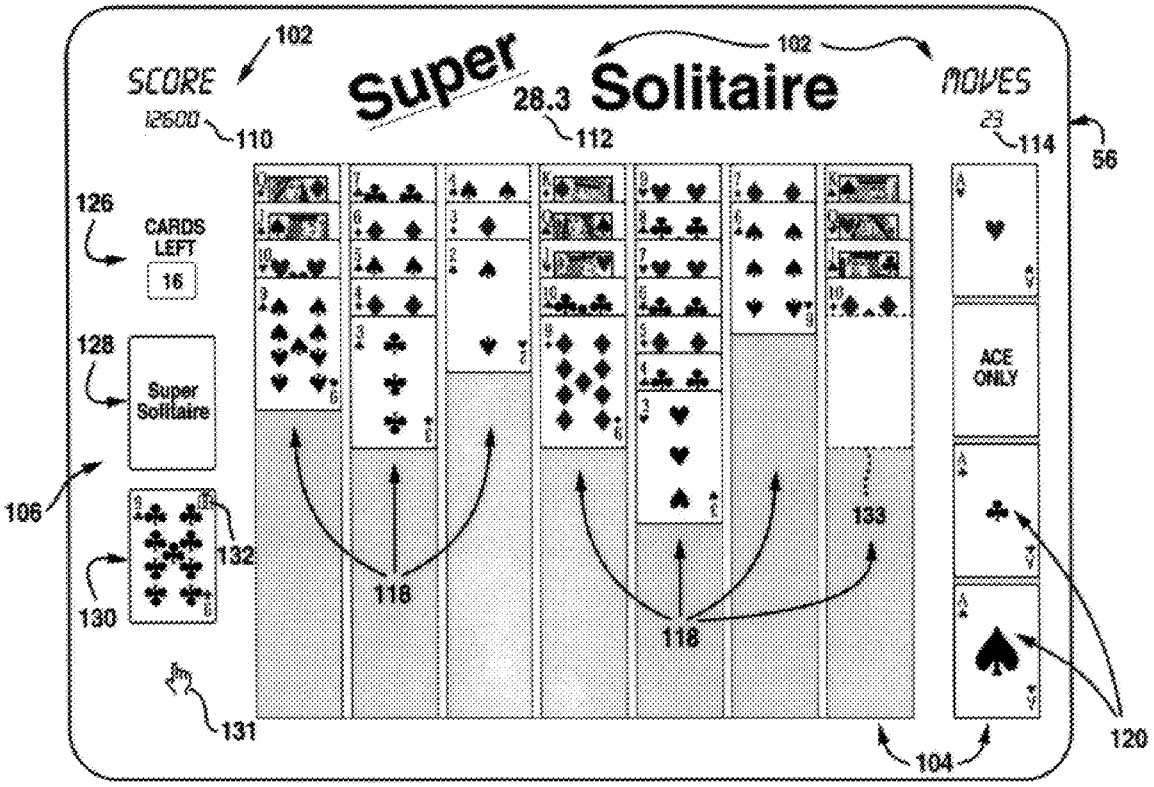
FIG. 3 is a diagrammatic illustration of a solitaire-style embodiment of the present invention.

FIG. 3 is an illustration of display screen 56 displaying a skill solitaire card game embodiment according to the present invention. Display screen 56 displays game area 100 which includes player information fields 102, played card field 104, and deck area 106. Information fields 102 include a score field 110, a timer field 112, and a moves field 114. Score field 110 indicates the current player score based on moves made by the player during the game. Game timer field 112 displays the time that has expired during moves in the game. The time displayed depends on the state of the game according to the present invention, and is described in greater detail below. Moves field 114 displays the number of moves the player has made in the current game, e.g. how many cards the player has moved from one location to another, according to the rules of solitaire.

Played card field 104 is displayed similarly to a standard solitaire card game layout. Columns 118 may each include zero or more overlapping cards arranged in columns as shown. As according to the rules of solitaire, the cards may be arranged only such that the cards alternate in color within a column, i.e., only a black-suited card can be placed on top of a red-suited card, and vice versa; and the numerical value of the card must decrease down the column, such that only a card having a value of n−1 is placed on a card having a value n (where, of course, the order K, Q, J, and 10 is a descending order). Ordered card stacks 120 is separate from columns 118 and is used to place cards removed from columns 118. The object of the game is to place all cards from columns 118 (or deck area 106) into stacks 120 such that the cards are in descending order in stacks sorted by suit. Thus, stacks 120 are each for a separate suit of card, and start empty, where only an Ace card can be placed thereon. Cards of increasing value are placed over each other in the appropriate stack 120.

Deck area 106 is where the player draws new cards from a deck 128 of multiple cards. "Cards left" field 126 indicates how many cards remain in deck 128; deck 128 is displayed so that the player cannot see the next card in the deck. Drawn card 130 indicates the most recent card drawn from deck 128. Multiple cards may be included "underneath" card 130, where the previously drawn cards are considered in a stack underneath the topmost card 130 that is displayed. Cursor 131 is moved by the player using an input device such as a track ball, joystick, etc. to select different images on the display screen 56.

The game of solitaire proceeds basically as follows. Seven cards are randomly drawn from the deck 128 and each card is placed at the beginning of a column 118. The player then draws a card from deck 128 and attempts to make a "move", e.g., to place the drawn card 130 on one of the columns 118 according to the alternating suit-decreasing card value rule, or to place one column 118 on another column 118. For example, card 132, as a 9 of clubs, can be placed on the 10 of diamonds card in the rightmost column 118, as shown by dashed outline 133. A card may also be placed in ordered stacks 120. If the card cannot be placed (i.e., a move cannot be made), then the player leaves the drawn card out, draws another card to be shown as card 130 and attempts to place the new card. A player continues to draw cards and make moves (or leave cards in the stack under card 130) until all the cards in the deck are drawn, at which point the game is over. During the game, the player may place cards from columns 118 to stacks 120 if desired and if the value of the card is appropriate. The player may also take one column 118 of cards and place it on the end of a different column 118 of cards if card values and suit colors are appropriate. However, the player preferably cannot place a single card from a column 118 and place it on a different column 118, even if the value and suit are appropriate for such an action (in alternate embodiments, the player may be allowed to do this).

The present invention improves on the random nature of solitaire and allows a player to exert more skill when playing the game. This is described in greater detail with respect to FIG. 4, below.

Figure 4:
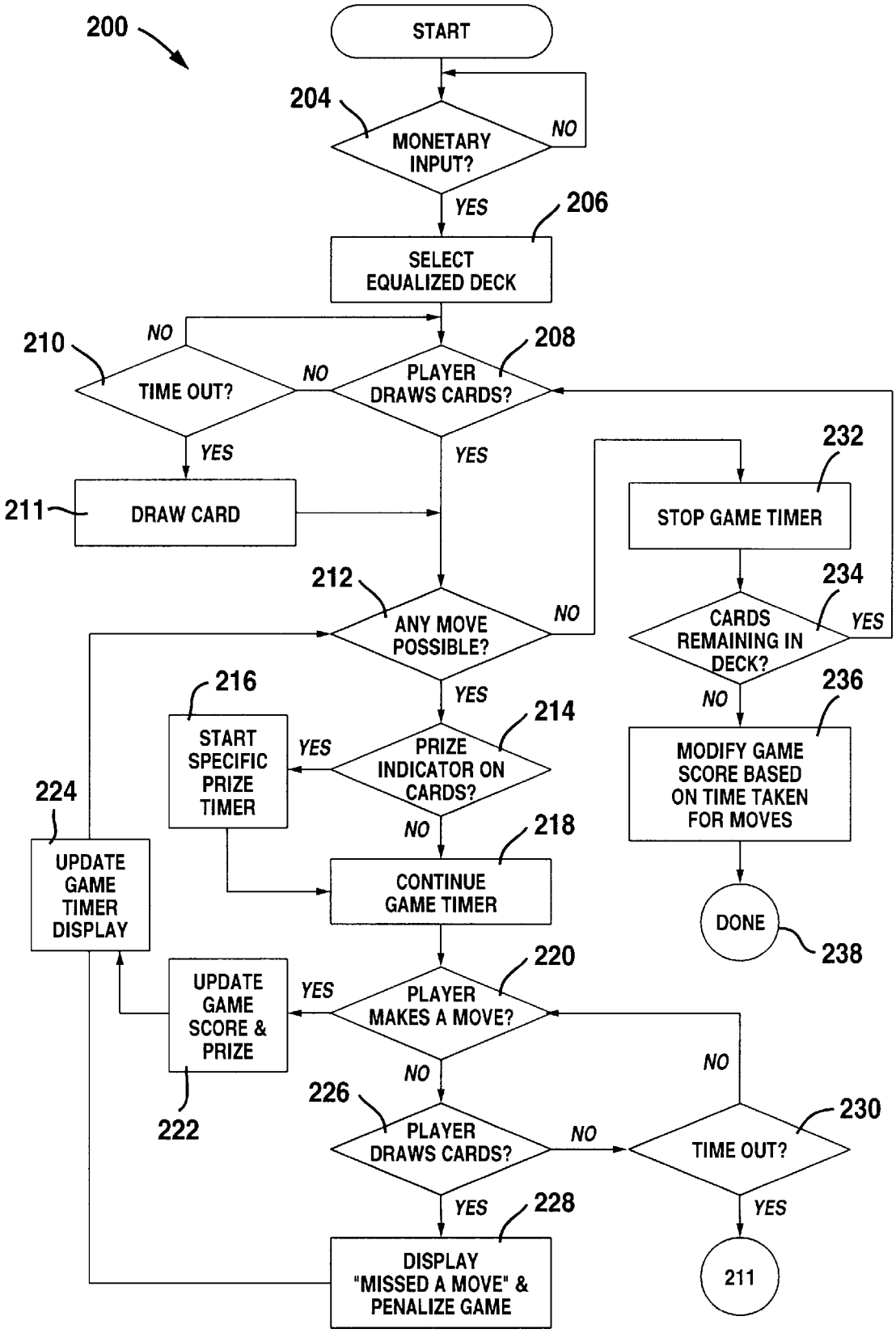
FIG. 4 is a flow diagram illustrating a method of the present invention for providing a skill-based card game.

FIG. 4 is a flow diagram illustrating a method 200 of the present invention for providing a card game requiring greater skill from the player. The method 200 is described with reference to the solitaire game embodiment of FIG. 3; however, the method 200 (as shown or with slight modification) is also applicable to other card game embodiments. One such embodiment is described with reference to FIG. 5. The steps of method 200 are preferably performed by game processor 12 of game unit 10 according to program instructions or code that is stored on a computer readable medium, such as a hard disk, CD-ROM, memory chip or device, PCMCIA card, tape, floppy disk, or other medium.

The method begins at 202. In step 204, the process checks whether sufficient monetary input has been provided by the player to play the game. As described above, the monetary input can be coins, bills, credit or debit card, etc. Once monetary input has been provided, the process continues to step 206, where the process selects a seeded, equalized deck of cards to be used in the game.

One feature of the present invention that reduces the randomness of the card game and allows players to utilize skill to a greater degree in determining a card game's outcome is the provision of "equalized" decks. That is, the decks of the present invention have been selected to reduce undesirable effects of randomness on the availability of moves during the game. This is accomplished in the preferred embodiment by pre-selecting decks for the game which have a predetermined minimum number of guaranteed moves for the player. For example, the game developer can generate a number of random 52-card decks by using random seed numbers, as is well known to those skilled in the art. These randomly generated decks can be each tested beforehand to determine how many moves they allow a player in a game. Thus, the game developer tests each deck in the desired game, e.g., solitaire, to determine how well the deck plays. Although many different "paths" can be taken during a card game depending on the moves made during the game, each deck can be tested to determine, on average, how many moves are allowed by the deck. Those decks that allow, on average, at least the minimum desired number of moves (such as 15) are kept as an equalized deck, while the decks that allow, on average, less than the minimum number of moves are "thrown away." Thus, for example, a deck that allows 30 moves based on one particular sequence of moves in the game but only allows 5 moves when other move sequences are made would typically not, on average, meet the minimum requirement. It is desired that a deck produce the minimum number of moves most of the time so that the player will not usually have a poor game result based only the random order of the cards. Thus, it is preferred that a deck be tested multiple times to determine the average moves produced by the deck.

The selected decks remaining after this filtering process are then stored in a list on a computer readable medium such as ROM 32 or RAM 30 and made accessible to the game processor 12. In step 206, the game processor can randomly select a deck from this list of equalized decks. In alternate embodiments, the decks can be equalized to an even greater degree, so that all the decks all have a number of moves within a smaller range or all have the same number of moves (on average).

In yet other embodiments, equalized decks can be produced in other ways. For example, wild cards such as a joker card, which might allow any move or a greater range of moves in the game, can be interspersed in a deck at regular or random intervals to equalize each deck. Or, if a move has not been available during a game for a predetermined number of cards drawn from the deck, then the game processor can cause such a wildcard to be drawn to help the player and equalize the deck with other decks providing more moves. Or, the randomly produced decks can be filtered at a very detailed level so that, no matter what the move sequence during the game, the deck produces the minimum number of moves from the beginning of the game. In other embodiments, the decks need not be randomly produced, but can be arranged in predetermined sequences that are equal to each other in producing moves. One of these predetermined decks can be randomly selected for a game from a large pool of such predetermined decks.

This equalization feature substantially reduces the effect of randomness from card decks in game play. In previous card games, the decks are purely random; since the prior art games have no way to equalize decks, there is an equal chance a deck with a maximum of 2 moves will be provided as a deck with 30 moves. The player can thus get stuck or lose a game within a few moves even if that player is very skilled at the game based on a purely random result. In the present invention, the player is guaranteed a minimum number of moves with which the player can exercise his or her skill. This equalizes the performance of one player with those of other players and allows players to compare scores since their performance was not as adversely affected by randomness as in previous card games. The other skill elements of the present invention, described below, can be used by the player to reduce the effect of randomness further.

In next step 208, the process checks whether the player has drawn a card from the selected deck. For example, in the embodiment of FIG. 3, the process checks whether the player guides cursor 131 to deck 128 and clicks a button or otherwise inputs a selection. If the deck 128 is selected by the player using cursor 131, the drawn card is displayed as card 130, and the process then continues to step 212. If the player has not drawn a card, step 210 checks for a time out, i.e., whether a predetermined amount of time has expired since the game began. The player can be warned with visual and/or auditory feedback that a time out is about to occur. If the time out has not yet occurred, the process continues to check for a drawn card at step 208. If a time out occurs, the process continues to step 211, where the game processor automatically draws the next card from the deck 128, and then proceeds to step 211. If no more cards are in the deck, the game is over and the process continues to step 236. In this fashion, the game process will continue to draw cards if no input is made by the player until the deck runs out of cards and the game is over. Alternatively, the game can simply end when the initial time out occurs.

Once the drawn card is displayed, step 212 checks whether any move in the game is possible (or "available"). A "move", as explained above, is the ability for the player to place a card, match a card, or otherwise perform a game action that will add points to the player's score (i.e., a "game scoring opportunity"). For example, in the solitaire embodiment of FIG. 3, a move is "possible" when the player can place the drawn card 130 onto a column 118, or when the player can place a column 118 of cards on the end of a different column 118 of cards (e.g., a column of cards 4-3-2 can be placed on a different column having cards 8-7-6-5, with the appropriate suit colors). In the preferred solitaire embodiment, placing a card on the ordered card stacks 120 from columns 118 or deck 128 is a move that will score points in the game, but is not considered a move that is "possible" or "available" in step 212, i.e., a move onto stacks 120 does not affect the game timer. This is because such a move may be optional in the game of solitaire, i.e., the player may not wish to move a card to the stacks 120 when possible since that card might be more helpful for playing other cards when placed in a column 118. In other embodiments, placing a card onto stacks 120 can affect the game timer like other moves in the game.

If a move is not possible, the process continues to step 232, detailed below. If a move is possible, then the process continues to optional step 214. In step 214, the process checks whether to provide an opportunity to win a specific prize (or "instant prize") for the player on the drawn card. In the described embodiment, a specific prize opportunity is possible only if a move can be made as determined in step 212. Many different methods can be used to determine whether a specific prize should be offered. For example, the process can check a table listing specific prize win ratios and randomly determine whether a specific prize is to be offered for the drawn card. Alternatively, specific prizes can be offered according to a predetermined pattern, e.g., after n drawn cards that allow a move to be made. Or, the specific prize can be offered after a player achieves a threshold game score or achieves some other game goal, such as performing a move under a threshold time. Specific prizes are described in greater detail with respect to patent application Ser. No. 08/746,755. In alternate embodiments, specific prizes can be provided in other ways (such as when the game starts or based on external events); or, in other embodiments, no specific prizes need be provided at all.

If the specific prize is not to be provided on the drawn card, the process continues to step 218, detailed below. If a specific prize is to be provided on the drawn card, then in step 216 a specific prize timer is started. The prize timer is a timer separate from the game timer which allocates a predetermined amount of time for the player to make a move with the drawn card in order to win the specific prize. For example, when the card is drawn in step 208 and a specific prize is provided with that card, the player may be allocated 3 seconds to make a move with the drawn card to win the specific prize. If the 3 seconds expires before the move is made, the specific prize can no longer be won. If the move is made within the 3 seconds, then the specific prize is awarded to the player. For example, a specific prize ticket can be immediately dispensed from dispenser 22 which depicts the won prize, and which the player can redeem for the prize. In addition, a specific prize indicator is preferably displayed on the drawn card 130. For example, as shown in FIG. 3, a specific prize icon 132 is displayed in the corner of the card to indicate the specific prize may be won. In addition, the specific prize timer is preferably displayed on the screen (as it counts down) to indicate the amount of time the player has to perform the move and win the prize. Furthermore, a special sound can be output on speakers to further inform the player that a specific prize may be won. In other embodiments, the specific prize indicator can be displayed in other areas of the game screen. In other embodiments, a prize timer need not be provided, and a specific prize can be won in other ways, such as by placing a predetermined number of cards on a stack 120, scoring a certain number of points, etc.

In next step 218, the process continues the game timer. The timer may have been started and stopped previously in the game process 200, and thus may already have logged a certain amount of time; the timer is continued from this previous time value. For example, game timer 112 in the solitaire embodiment of FIG. 3 indicates an amount of seconds that has expired.

The game timer, as used herein, is an important feature of the present invention since it allows the player to exercise skill in achieving game results. This is because the game timer is used to record time that has expired only when one or more moves are available to be made by the player in the game. If no move is possible, the timer is stopped (as detailed below), and is only continued when a move later becomes possible (except, preferably, for a move onto stacks 120, since such a move is optional). Thus, step 218 is only performed after an affirmative result of step 212.

In the preferred embodiment, the game timer is not updated on the screen 56 as it counts down after being continued in step 218. Thus, the game timer displays the last updated time as a static display until updated in step 224, detailed below. This feature prevents the player from knowing when a move is possible in the game. If the game timer were shown counting down after step 218, the player would know that a move could be made in the game and thus remove an element of skill required to recognize when moves are available with the displayed cards.

In next step 220, the process checks whether the player has made a move (during the process 200, the game processor updates the images on screen 56 appropriately as the player moves the cursor, selects cards, moves cards, etc., as is well known to those skilled in the art). If a move has been made, then the game score is updated appropriately in step 222. For example, in FIG. 3, the player might place drawn card 130 onto a card column 118, which might be worth 200 points. The 200 points are added to the game score in step 222. Different point scores can be assigned to different moves in the game; for example, moving a drawn card 130 onto a column 118 might be worth 200 points, moving one column 118 onto another column 118 might also be worth 200 points, and moving a card onto stacks 120 might be worth 10,000 points. If any specific prize was won (e.g., the player made the move within the specific prize time), then a specific prize ticket can be dispensed or the specific prize information otherwise updated.

In next step 224, the game timer display 112 is updated to reflect the current game time. Thus, when a player makes a move in the game, the player may immediately see how much time has elapsed in the game. The player can also view the number of moves made in field 114 and, with the expired game time, may estimate how well he or she is doing during the game.

The process then returns to step 212 to check whether any moves are still possible. For example, after the player places a drawn card 130 onto a column 118, this may open up another move, such as a column 118 now being able to be placed on a different column 118. Or, a card that was in the stack "underneath" drawn card 130 (i.e., previously drawn but not able to be placed) may now be displayed as card 130 and may be able to be placed on a column 118. It should be noted that if additional moves are still possible in step 212 after the player makes a move at step 220, the specific prize check in step 214 has a negative result (since no new card has been drawn), and the game timer need not be started again in step 218 (since the timer was never stopped).

If the player does not make a move in step 220, then the process checks whether the player draws another card at step 226. For example, the player may not recognize that a move is available, and thus may (wrongly) assume that a new card must be drawn from deck 128. If the player draws a card at step 226, the new card is displayed as card 130, and then in step 228 a message is displayed to the user indicating that the player missed a move with the last card. In addition, when the player misses a move, a variety of penalties can be implemented. For example, an amount of time (such as 10 seconds) can be automatically added to the game timer. Alternatively, a number of points can be subtracted from the player's game score. Other penalties can also be assessed, depending on the desired effect on game play and game score. The process then continues to step 224 to update the game timer display, and then returns to step 212 to determine whether any moves are possible with the new card drawn at 226.

If the player does not draw a new card at step 226, then in step 230 the process checks whether there is a time out, i.e. whether a predetermined minimum amount of time has expired, similar to step 210. If not, the process returns to step 220; if so, the process continues to step 211, detailed above.

At some point in the game, no more moves will be available in the game when step 212 is implemented. For example, the drawn card 130 is not able to be placed on any column 118 or 120, and no column 118 can be placed on any other column. When no moves are possible, the process continues from step 212 to step 232, where the game timer is stopped. This feature of the present invention times a player's participation in a game only when a move is available, and stops the timer when a move is not available. Thus, the time of a player's performance is not increased due to uncontrollable circumstances based on deck randomness.

In step 234, the process checks whether there are any cards remaining in the card deck 128. If so, then the process returns to step 208 to check if the player draws another card. If not, then the game is over. In the described embodiment, the process preferably displays a "game over" indicator on deck 128, such that when the player selects the deck 128 with the cursor, the game is exited. In step 236, the game score is modified by the game time that has expired when a move was available in the game. For example, in the described embodiment, the game score is divided by the game time to achieve a resulting total score. This division is preferably displayed to the player to show how the total score was calculated. The total score is then displayed as the final result. Thus, a small game time is desired so that the game score will be divided by a small number. In alternate embodiments, the game score can be modified in other ways. For example, the game time can be translated into a number of bonus points which are then added to the game score, where the lower the game time, the greater the number of bonus points. Such a translation can be preformed using an equation or a look-up table, for example. Alternatively, the points translated from the game time can be substracted from the game score to get the total score. In addition, if a prize redemption system is included on game unit 10, then the total score can be converted to prize credits by some predetermined adjustment factor, and the player can select a prize using the prize credits. The process is then complete at 238.

Some or all of the steps in method 200 can be performed in another sequence or simultaneously, if appropriate. For example, the process can determine if any move is possible in step 212 and whether a specific prize should be provided before step 208, since the game processor knows the next card from the order of cards in the equalized deck of step 206.

The present invention thus allows player skill to be determinative in the final score of the game to a degree not before possible in card games. Since the score is divided only by the game time expired when moves were available, the player's skill in recognizing when such moves are available and quickly performing those moves is determinative in the final score. In addition, a player's skill is factored in avoiding penalties for missing moves that are available. A player who can quickly recognize when moves can be made and who performs those moves quickly can achieve a larger score than a player, using the same card deck, who takes longer in recognizing moves or does not recognize them at all. This is much different than the traditional arcade game technique of timing a game and offering a "speed bonus" to the game score based on the total time taken by the player to complete the game. Such a technique only records the time expired during the entire game and makes no distinction between timing the game when moves (or other game-scoring opportunities) are available and stopping the timer when moves are not available.

In addition, the equalized decks described in step 206 further contribute to the skill aspect of the game, since a player relies less on the random result of getting a "good" deck with many moves versus getting a poor deck with only a few moves. The equalized decks offer a minimum number of moves and thus mitigate the detrimental result of getting a poor random deck.

Figure 5:
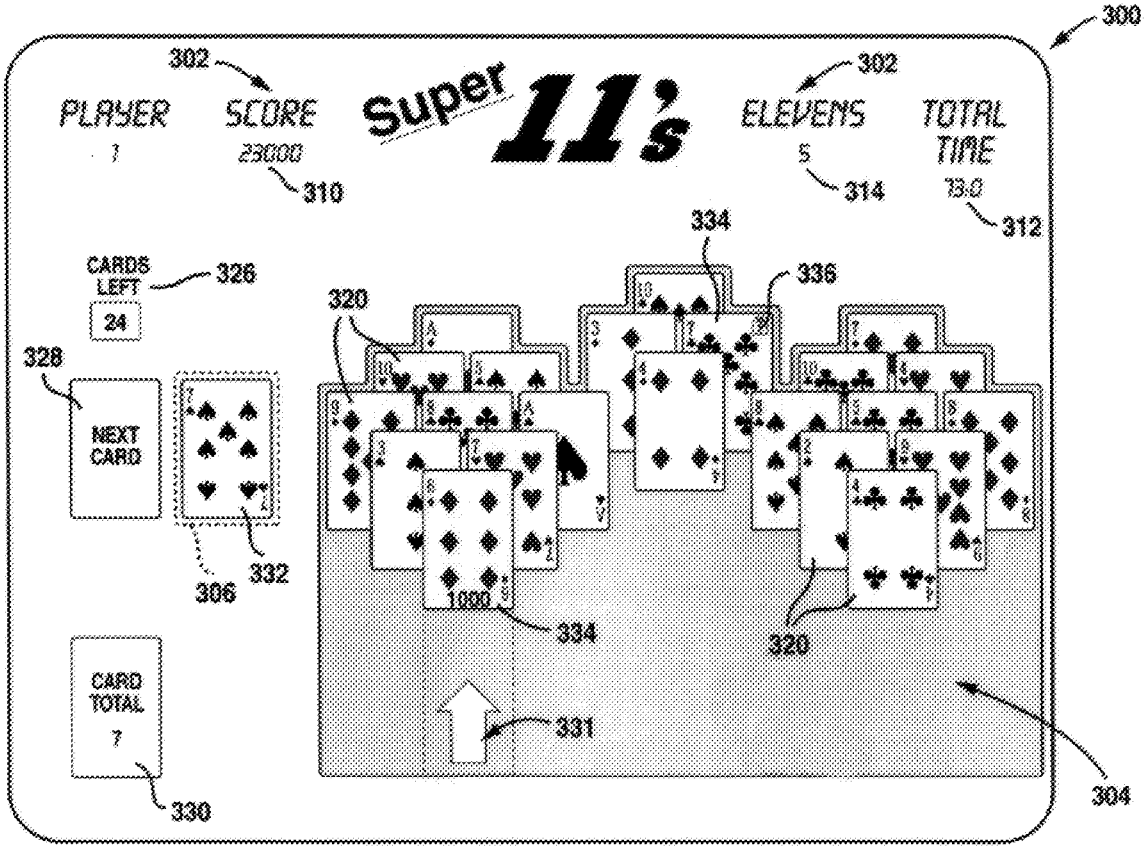
FIG. 5 is a diagrammatic illustration of a second card game embodiment of the present invention.

FIG. 5 is an illustration of display screen 56 displaying another embodiment of a skill-based card game according to the present invention. The game of FIG. 5 is generically known as "elevens", where the player attempts to add values of cards to achieve a predetermined total value, in this case the value of 11. Display screen 56 displays game area 300 which includes player information fields 302, displayed card field 304, and deck area 306. Information fields 302 include a score field 310, a timer field 312, and a moves field 314. Score field 310 indicates the current player score based on moves made by the player during the game. Game timer 312 displays the time that has expired during game moves, as according to the present invention. Moves field 314 displays the number of moves (or "elevens") the player has made in the current game, e.g. how many selection sets the player has made that add up to 11, according to the rules of the game.

Displayed card field 304 includes a number of overlapped cards 320. Preferably, at the beginning of a game, the cards in card field 304 are drawn in sequence from an equalized deck of the present invention and are placed in display area 304 in a left-to-right, top-to-bottom order. Cards that are placed on top of other cards must be selected by the player before the cards that are positioned underneath other cards. In the described embodiment, three groups are cards are shown that are arranged in six different levels of overlapping. Preferably, cards that are further toward the bottom of the overlapping hierarchy are worth more points than cards at the top. For example, in the configuration of FIG. 5, the 6 of diamonds card can be worth 1000 points, the ace of spades can be worth 3000 points, the 3 of diamonds card can be worth 5000 points, and the 10 of spades card can be worth 6000 points.

Deck area 306 is where the player draws new cards from a deck of multiple cards. Cards left field 326 indicates how many cards are left in the equalized deck. Drawn card 332 is the current card in play. The player can select next card button 328 to draw another card from the deck. Card total field 330 indicates the sum of values of the cards currently selected by the player. The player may select cards, buttons, or other features of the game field 300 using a cursor 331, which can be controlled using an input device such as a track ball, joystick, knob, mouse, etc.

The game of elevens proceeds basically as follows. A number of cards (e.g., 22 in FIG. 5) are drawn from a preferably equalized deck and the cards are placed in an arrangement where the cards overlap in a left-to-right, top-to-bottom order, such as the arrangement shown in FIG. 5. The player then draws a card from deck by selecting the next card button 328 and attempts to make a move. In the described embodiment, a "move" occurs when the player selects any number of cards to add up to a predetermined value such as 11. The player can select cards using cursor 331, and any cards shown on the display screen may be selected. For example, the player has selected drawn card 332 in FIG. 5 and has then moved the cursor over to the right to align the cursor with card 334, the 6 of diamonds. However, selecting the 6 would cause the total to be 13, which is over the desired value of 11. The player can control the cursor to select card 336, the 4 of diamonds, thus adding to 11, and a move has been made. This causes cards 332 and 336 to be removed from the display, uncovering the cards just beneath those cards and allowing the exposed cards to be selected. The player proceeds similarly; when a move cannot be made, the player can draw another card using next card button 328 until a move can be made. When the deck has run out of cards and no more moves can be made, the game is over. In some embodiments, a player can be allowed to cycle through the deck multiple times before a game is over.

Preferably, when the player selects the next card button 328 while a card 332 is still displayed, the drawn card 332 is placed into the display area 304 in a predetermined order, such as left-to-right and top-to-bottom. For example, if card 334 had been previously removed, and the player selects the next card button 328 because no move was possible (or a move was missed by the player), then card 332 would be placed in the position that card 334 had held. Thus a player can choose to draw new cards knowing where the card 332 will be placed into area 304; this is a further skill factor in the game. If no positions are open in area 304, then the card 332 can be discarded or recycled on the bottom of the deck.

Preferably, a specific prize option is available in the embodiment of FIG. 5 as well, similar to the embodiment of FIG. 3. One way to implement the awarding of specific prizes is to designate one or more of the cards in area 304 and/or card 332 as specific prize cards. For example, card 334 has a specific prize icon 336 displayed in its comer. When the player includes card 334 in a selection of cards to achieve the desired total, the specific prize is won. Other limitations can also be added, i.e., the player must include card 334 in a selection of four or more cards to add up to eleven in order to win the specific prize; if the player includes card 334 in a combination of, for example, 2 cards that add up to eleven, no prize is won. Or, the card 334 must be selected within a predetermined time period from the beginning of the game to win the specific prize. Alternatively, a specific prize icon can be included on the drawn card 332 and a specific prize time limit can be provided in which to include the card 332 in a move, similar to the embodiment of FIG. 3. In addition, progressive score goals can be designated in both embodiments of FIG. 3 and FIG. 5 to allow the player to win a progressive bonus award or score, as described above. For example, a player that achieves a very high score can win a progressive bonus score or prize that was contributed to by previous games and/or different game units.

The game embodiment of FIG. 5 can be implemented in a similar process to that of FIG. 4. An equalized deck can be provided in the elevens embodiment as in the solitaire-type embodiment. The game time is run only when a move is possible in the game. In addition, if a player does not recognize that a move is available and draws the next card, a penalty is preferably assessed similar to step 228 of FIG. 4. And, as in FIG. 4, the game timer display 312 is preferably only updated after a move is made and not continually during the game. Thus, game 300 has the same skill-based out as that of the embodiment of FIG. 3, where the player's skill in recognizing that a move can be made and speed in performing the moves primarily determines the game score, not a random distribution of cards. Differences between the embodiment of FIG. 5 and FIG. 3 can be provided in steps, or steps can be omitted, in FIG. 4 as appropriate; for example, the specific prize can be checked if won when a move is made in step 222, where the process checks if four or more cards were used to sum the predetermined total value.

Other variations of the above-described card game embodiments, or other types of card games, can also be implemented according to the present invention. The present invention is particularly adaptable to card games in which a player recognizes that a move or match can be made, such that the timing of the moves can influence the game outcome. For example, another type of card game somewhat similar to elevens can be played, known as "Tri-towers". A number of overlapping cards can be provided in a triangular configuration or group in a display area, similar to the diamond-shaped groups of cards in area 304 of FIG. 5. Multiple triangles of cards can be displayed. The player draws a card from a deck, similar to card 332 of FIG. 5. The player can select the drawn card and a card in the display area with a cursor to match the drawn card with card in the display area having a value one greater or one less than the value of the drawn card. Preferably, only cards that are not covered by any other cards can be matched to the drawn card. If such a match is made, the drawn card is removed (e.g. placed in a discard pile) and the matched card is moved from the display area to the side area and becomes the next drawn card. Thus, the player continues making such matches until the game goal of removing all the cards from the triangular configurations is complete. If no matches can be made, the player can draw another card from the deck, where the previous drawn card is discarded. The same features of providing a game timer that records time only when a move (i.e. a match) can be made, and equalized decks, are quite applicable to this embodiment. In some embodiments, the game is over when no more cards can be drawn form the deck; or the player can be allowed to play multiple cycles through a deck. The other features of the embodiments of FIG. 3 and/or 5 can also be included.

In addition, other similar games in which objects, or other game pieces are played in a game space can be adapted to the present invention. For example, in a two-player competitive game, the player can move pieces on a board when conditions allowing such moves are recognized by the player, and where the skill of the player is made more relevent through the use of timing the game only when moves are available.

While this invention has been described in terms of several embodiments, it is contemplated that alterations, permutations, and equivalents thereof will become apparent to those skilled in the art upon a reading of the specification and study of the drawings. For example, many types of games can be provided for use with the disclosed skill-based system. Various goals or moves can be attempted by players which were formerly based on a random outcome but which can be more influenced by a player's skill according to the present invention. It is therefore intended that the following claims include all such alterations, permutations, and equivalents as fall within the spirit and scope of the present invention.

What is claimed is:

1. A method for providing a skill card game on a game apparatus, the method comprising:

providing cards from a deck to be played by a player according to rules of said card game, said deck from which said cards are provided is an equalized deck wherein the card arrangement is such that a predetermined minimum number of moves are available from said deck said player able to make at least one move during said game using at least one of said cards;

providing a game score based on said at least one move made during said card game;

recording the time duration in which said player makes said at least one move, wherein said time duration does not include time expired during said game in which moves cannot be made by said player in said card game; and adjusting said game score based on said time duration such that the less time expired during said at least one move, the greater said adjusted game score.

2. A method as recited in claim 1 wherein said cards are images displayed on a display screen of a game apparatus.

3. A method as recited in claim 2 wherein said move during said card game includes moving a card provided from said deck to a game card display area when predetermined conditions apply.

4. A method as recited in claim 3 wherein said card game includes a solitaire-style card game, and wherein said move includes moving said card provided from said deck onto another card provided in said display area according, at least in part, to rules of solitaire.

5. A method as recited in claim 4 wherein said display area includes a plurality of columns of cards, and said move includes moving one of said columns of cards onto another column of cards.

6. A method as recited in claim 2 wherein said move during said card game includes selecting a plurality of cards displayed on said screen.

7. A method as recited in claim 6 wherein said move is completed when said plurality of cards selected by said player have values that sum exactly to a predetermined value.

8. A method as recited in claim 7 wherein said card game is an elevens-style card game, and wherein said predetermined value is 11.

9. A method as recited in claim 7 wherein said card game includes a display area having multiple overlapping cards, and wherein a move includes matching a drawn card with a card in said display area having a value one greater or one lesser than said drawn card.

10. A method as recited in claim 2 wherein said time duration of said player making said at least one move is displayed to said player on said display screen and is updated only after said player makes said at least one move.

11. A method as recited in claim 2 further comprising penalizing said player when said player does not make said at least one move when said move is available.

12. A method as recited in claim 11 wherein said penalty includes adding a predetermined length of time to said time duration.

13. A method as recited in claim 11 wherein said penalty includes decreasing said game score by a predetermined amount.

14. A method as recited in claim 2 further comprising providing a specific prize goal during said card game that may be achieved by skill of said player, and wherein if said specific prize goal is achieved, said player receives a specific prize.

15. A method as recited in claim 14 wherein said specific prize is provided to said player by dispensing a specific prize ticket which describes said specific prize and which said player may redeem to receive said specific prize.

16. A method as recited in claim 14 wherein said specific prize is provided to said player from a prize distributor who receives information that said player has won said specific prize over a computer network.

17. A method as recited in claim 1 wherein said equalized deck is selected from a plurality of equalized decks, said plurality of equalized decks being selected from a plurality of randomly-determined decks.

18. A method as recited in claim 1 wherein said adjusting said game score includes dividing said game score by said time duration.

19. A method as recited in claim 1 wherein said adjusting said game score includes adding bonus points to said game score, a number of said bonus points being proportional to a length of said time duration.

20. A method as recited in claim 1 further comprising receiving monetary input from said player in exchange for playing said card game.

21. A game apparatus for providing a skill-based card game, said game apparatus comprising:

a monetary input device that receives monetary input from said player;

a player input device providing commands to said card game from said player;

an output display device coupled to said game processor and displaying images from said card game; and a game processor coupled to said monetary input device, said player input device, and said output display device, said game processor controlling said card game on said game apparatus, said card game providing cards from a deck to be played by a player according to rules of said card game, said deck from which said cards are provided is an equalized deck wherein the card arrangement is such that a predetermined minimum number of moves are available from said deck said player able to make a plurality of moves during said game with said cards based on skill of said player, wherein a game score is updated based on said moves made during said card game, and wherein a time duration of said player making said moves is maintained, said time duration excluding time expired during said game in which moves cannot be made by said player in said card game, and wherein said game score is adjusted based on said time duration such that said adjusted game score is inversely proportional to said time duration.

22. A game apparatus as recited in claim 21 wherein said card game includes Solitaire, and wherein said moves include moving said card provided from said deck onto another card provided in a display area according to rules of Solitaire.

23. A game apparatus as recited in claim 21 wherein said move during said card game includes selecting a card provided from said deck and at least one other card provided in a card display area, wherein said move is completed when said cards selected by said player have values that sum exactly to a predetermined value.

24. A game apparatus as recited in claim 21 wherein said time duration of said player making said moves is displayed to said player on said output display device and is updated only after said player makes each of said moves.

25. A game apparatus as recited in claim 24 further comprising penalizing said player when said player does not make one of said moves when said move is available.

26. A game apparatus as recited in claim 21 further comprising a prize output device coupled to said game processor that outputs a specific prize ticket designating a specific prize won by said player during said card game.

27. A game apparatus as recited in claim 21 further comprising a universal ticket dispenser for dispensing universal tickets proportional in number to said adjusted game score.

28. A game apparatus as recited in claim 21 wherein said monetary input device includes a coin slot.

29. A method for providing a card game having a result based on skill of a player, said method comprising:

providing a deck of cards having a plurality of cards in a display area of a display screen, wherein said deck of cards is an equalized deck having a card arrangement providing a predetermined minimum number of moves in said card game;

providing drawn cards to said player on said display screen;

timing the duration that said player makes moves in said card game using said cards, said moves based on skill of said player, said timing being performed only when a move is possible in said card game; and determining a game score based on said moves and based on a time duration recorded only when said moves are possible in said card game, such that said game score is inversely proportional to said time duration.

30. A method as recited in claim 29 wherein said plurality of cards in said display area and said drawn cards are provided from a deck of cards.

31. A method as recited in claim 29 further comprising penalizing said game score when said player misses making said moves when said moves are possible.

32. A method as recited in claim 29 wherein said card game is Solitaire, and wherein said moves include moving a drawn card onto a column of cards or moving a column of cards onto a different column of cards.

33. A method as recited in claim 29 wherein said moves include selecting a drawn card and at least one displayed card to sum values of said selected cards to a predetermined value.

* * * * *